US008875752B2

(12) United States Patent
Monzel

(10) Patent No.: US 8,875,752 B2
(45) Date of Patent: Nov. 4, 2014

(54) METHOD AND DEVICE FOR FILLING IN PARTICULAR LARGE-VOLUME CONTAINERS

(75) Inventor: Alois Monzel, Mörstadt (DE)

(73) Assignee: KHS GmbH, Dortmund (DE)

( * ) Notice: Subject to any disclaimer, the term of this patent is extended or adjusted under 35 U.S.C. 154(b) by 802 days.

(21) Appl. No.: 12/933,048

(22) PCT Filed: Mar. 17, 2009

(86) PCT No.: PCT/EP2009/001942

§ 371 (c)(1),
(2), (4) Date: Sep. 16, 2010

(87) PCT Pub. No.: WO2009/121477

PCT Pub. Date: Oct. 8, 2009

(65) Prior Publication Data

US 2011/0017345 A1 Jan. 27, 2011

(30) Foreign Application Priority Data

Apr. 1, 2008 (DE) ..... 10 2008 016 846

(51) Int. Cl.
*B67C 3/00* (2006.01)
*B67C 3/30* (2006.01)

(52) U.S. Cl.
CPC ..... *B67C 3/30* (2013.01)
USPC ..... 141/196; 141/2; 141/94; 141/95

(58) Field of Classification Search
USPC ..... 141/2, 83, 94, 95, 192, 196
See application file for complete search history.

(56) References Cited

U.S. PATENT DOCUMENTS

| | | | | | |
|---|---|---|---|---|---|
| 4,676,282 | A * | 6/1987 | Bellini et al. | ..... | 141/1 |
| 4,856,563 | A * | 8/1989 | Yamaguchi et al. | ..... | 141/1 |
| 4,897,226 | A * | 1/1990 | Hoyle et al. | ..... | 261/129 |
| 5,148,841 | A * | 9/1992 | Graffin | ..... | 141/83 |
| 5,156,193 | A * | 10/1992 | Baruffato et al. | ..... | 141/1 |
| 5,168,905 | A * | 12/1992 | Phallen | ..... | 141/1 |
| 5,287,896 | A * | 2/1994 | Graffin | ..... | 141/9 |
| 5,515,888 | A * | 5/1996 | Graffin | ..... | 141/1 |
| 5,957,171 | A * | 9/1999 | Matsuo | ..... | 141/83 |
| 5,996,650 | A * | 12/1999 | Phallen et al. | ..... | 141/83 |
| 6,148,877 | A * | 11/2000 | Bethke | ..... | 141/103 |
| 6,321,798 | B1 * | 11/2001 | Solignac | ..... | 141/2 |
| 6,334,471 | B1 * | 1/2002 | Graffin | ..... | 141/83 |
| 6,397,906 | B2 * | 6/2002 | Hansen | ..... | 141/196 |

(Continued)

FOREIGN PATENT DOCUMENTS

| | | |
|---|---|---|
| DE | 28 15 980 | 10/1979 |
| DE | 30 08 213 | 9/1981 |

(Continued)

*Primary Examiner* — Timothy L Maust
(74) *Attorney, Agent, or Firm* — Occhiuti & Rohlicek LLP

(57) ABSTRACT

A device for filling containers with a liquid by supplying the liquid at a predetermined rate of flow, the rate of flow being predetermined as a function of one or more parameter value(s) measured in parallel and in combination with rate values of at least one prior filling operation associated with the parameter values includes a sensor for measuring a parameter value at a fill point, an adjustable valve for presetting the rate of flow, and a control unit that adjusts the valve in accordance with the parameter value, the control unit having a memory in which are stored rate values of a prior fill operation associated with the parameter values, and that predetermines the current rate of flow in combination with the parameter values by making corresponding adjustments of the valve.

20 Claims, 2 Drawing Sheets

(56) References Cited

U.S. PATENT DOCUMENTS

| | | | | |
|---|---|---|---|---|
| 6,609,431 | B1 * | 8/2003 | Tietsworth et al. | 73/861.52 |
| 6,857,453 | B2 * | 2/2005 | Nishino et al. | 141/83 |
| 7,066,217 | B2 * | 6/2006 | Ludwig | 141/100 |
| 8,176,947 | B2 * | 5/2012 | Frei et al. | 141/1 |

FOREIGN PATENT DOCUMENTS

| | | |
|---|---|---|
| DE | 19612797 | 10/1996 |
| DE | 196 48 493 | 5/1998 |
| DE | 102005035264 | 2/2007 |
| EP | 1 898 189 | 3/2008 |
| EP | 1905729 | 4/2008 |
| FR | 2 784 669 | 4/2000 |
| GB | 2 086 861 | 5/1982 |
| WO | 90/15755 | 12/1990 |
| WO | 2004/051200 | 6/2004 |
| WO | 1 905 729 | 4/2008 |

* cited by examiner

METHOD AND DEVICE FOR FILLING IN PARTICULAR LARGE-VOLUME CONTAINERS

CROSS-REFERENCE TO RELATED APPLICATIONS

This application is the National Stage of International Application No. PCT/EP2009/001942, filed on Mar. 17, 2009, which claims the benefit of German Application Serial No. 10 2008 016 846.7, filed on Apr. 1, 2008, the contents of both of the foregoing applications are hereby incorporated by reference in their entirety.

FIELD OF DISCLOSURE

The invention relates to a method for filling in particular large-volume containers with a liquid, in particular a gaseous beverage, according to which method the liquid is supplied at a predetermined rate of flow.

BACKGROUND

These types of filling methods are generally used in the case of carbonated beverages, for example for bottling beer or in general in the beverage industry. Within the framework of beer bottling, so-called keg barrels are used as large-volume containers. These are returnable barrels, the volume content of which, as a rule, is 30 l or 50 l, for example.

Such keg barrels are provided at their top side with a valve, the so-called keg head, onto which a suitable tap head can be fitted. By means of the tap head, carbon dioxide is regularly supplied from an external vessel so that the contents of the keg barrel can be discharged to the dispensing head. By means of the propelling gas, an over pressure is generated in the keg, which, when the tap is opened, presses the contents out through a pipe in the interior of the keg. When the tap head is removed, the valve closes the keg in an air-tight manner, thereby making further storage of the contents possible. The overpressure in the barrel interior remains constant and reduces any foaming of the beverage.

These types of bottling methods are used in many cases in practice and, for example, are the object of DE 30 08 213 A1.

Over and above this, it is generally known and from another context through DE 196 48 493 A1 that in the case of a method for the repeatable metering of liquid in a selectable, reproducible amount, a metering operation that has been accomplished once manually can be learnt and stored so as to be called up. These types of methods of operation, however, are not known in the filling of beverages because, in this case, it is a question of filling the respective keg barrel or generally the large-volume container as rapidly as possible.

In this case, it has emerged in practice that the rate of flow through a filling section and, as a consequence, the rate of filling for the container, in particular when filling the container with gaseous beverages and in this case preferably carbonated products, is restricted. Said limitation is produced on account of the fact that when a maximum value for the outlined rates is exceeded, the carbon situated in the liquid tends to outgas and consequently starts to form foam. This foam formation makes the filling of the container considerably more difficult.

For this reason, varying rates of flow, which are geared to the filling level or fill level inside the container, are already used in practice and there is still a demand for considerable improvement here. For in practice, the fill section is usually of a considerable length and this results in a more or less large liquid volume being situated inside the fill section, which periodically delays a change in the rate of flow. This often brings about incompatibilities in practice in such a manner that a rate of flow is observed at a discharge opening of the fill section other than the one that has been predetermined along the fill section, for example, by means of a controllable valve. This is where the invention fits in.

SUMMARY

The technical problem underlying the invention is to develop further a method for filling in particular large-volume containers of the aforementioned development such that the filling process is optimized. In addition, a particularly suitable device is to be created. The aim of the optimizing, in this case in particular, is to increase the rate of flow when filling or the rate of fill. In addition, any pressure fluctuations or pressure surges observed in practice along the fill section should be reduced to a minimum. For such pressure surges or pressure fluctuations often result in the outgassing of the carbonation contained in the liquid.

To solve the problem outlined previously, in the case of a generic method for filling in particular large-volume containers with a liquid, it is provided that the current rate of flow is predetermined as a function of one or more parameter value(s) measured in parallel and in combination with rate values of at least one prior filling operation associated with the parameter values.

Within the framework of the invention, therefore, the currently desired rate of flow is predetermined not only as a function of one or more parameter value(s) measured in parallel, but said parameter values are combined with already known rate values which have been determined by way of one or more prior fill operations. This means the parameter values measured in parallel to the current rate of flow mirror a specific state of the liquid inside the fill section, but also the specific characteristics of the flow dynamics relevant to said specific fill section. For this state, a certain rate value for the rate of flow from a prior fill operation or from several prior fill operations has proven particularly beneficial. Said rate value of the at least one previous fill operation is then utilized to predetermine the current rate of flow. In this case, the measured parameter values naturally not only play a role when determining the rate value of the prior fill operation, but can also be additionally incorporated in the default for the current rate of flow, where applicable, by modifying the rate value from the past (derived from at least one of the prior fill operations).

In this context it has proved of value when the current rate of flow is optimized. In this case, there are various target courses or targets that can be pursued for optimization. As a rule, the course of action chosen is measuring the necessary fill time for the container as minimally as possible with consideration to a specific fill level. Another or an alternative goal can be that pressure surges or pressure fluctuations within the liquid do not occur or only occur minimally along the fill section. Obviously, other types of optimization by way of other targets are also conceivable and are included in the invention.

At all events, the respective rate value of at least one previous fill operation is taken as the initial starting point. This is then modified by increasing the rate, for example. If it transpires in this case that the targets have been maintained, it is the optimized current rate of flow.

The current rate of flow optimized to that effect can be stored in a rate value matrix together with the parameter values measured in parallel. The rate value of the one or the several prior fill operations has naturally already been recorded beforehand in the rate value matrix. This means the invention accesses the rate values that are stored in the rate value matrix and are associated with one or several prior fill operations in order, in conjunction with the parameter values measured in parallel, to predetermine the current rate of flow. Once an optimization as described here has been effected, the current optimized rate of flow is recorded in the rate value matrix and then functions, in its turn, as the respective rate value of a prior fill operation for a future fill operation.

In this case, the detailed procedure is such that the current (modified) rate of flow is compared with the rate of flow of the prior fill operation associated with the parameter values measured in parallel. Said rate of flow of the prior fill operation or corresponding rate values of the prior fill operation are stored as described in the rate value matrix. The comparison between the current (modified) rate of flow and the previous rate of flow is carried out with consideration to one or more targets. Said targets, for example, can be as short as possible a fill time for the container with consideration to a corresponding fill level.

If the result of said comparison is that, for example, the fill time is reduced with consideration to the current (modified) rate of flow, the current and consequently optimized rate of flow is then recorded into the rate value matrix in place of the previous rate of flow or the associated rate values. If, contrary to this, the rate of flow of the prior fill operation shows a shorter fill time, the entry of its rate values remain in the rate value matrix.

In this way, in the case in example of minimizing the necessary fill time for the container with consideration to a certain fill level, a self-learning process takes place by the current (modified) rate of flow being compared in each case with a prior rate of flow. At the end of said process, the optimized rate of flow determined in this manner or its rate values associated with the parameter values is or are recorded into the rate value matrix and are available for a subsequent fill operation as rate values of a now prior fill operation.

It has proven of value when the parameter values are determined at different fill points or locations between a storage container for the liquid to be filled and a discharge opening. In the case in example, the large-volume container, for example the keg barrel, is situated in the direct vicinity of the discharge opening. All in all, the current rate of flow is predetermined in terms of a closed control system. In this case, from the parameter values measured in parallel and the associated rate values of one or more prior fill operations as reference variables, the current (modified) rate value is derived in each case as actuating variable. Said current rate value corresponds to the current rate of flow, which, in its turn, is compared with the previous rate of flow with identical or comparable parameter values in terms of the self-learning process.

In this context it has additionally proven favourable when the control operates or is designed as co-called preliminary control. Such a preliminary control is characterized in that, for example, any deviations in the current rate of flow of the liquid product in its path from the fill point to the discharge opening are taken into consideration for the purposes of determining the parameter values. This means the flow and/or response behaviour of the respective fill point can be taken into consideration in this manner. The previously described flow and any delays when converting a change in the rate of flow are absorbed by this.

In this way a liquid volume present between the fill point and the discharge opening and its behaviour or the behaviour of the respective fill section can be taken into consideration in such a manner that an associated control valve for adjusting the rate of flow, for example for increasing it, does not open too much and then close abruptly because the liquid volume upstream damps down the increase in the rate of flow. Rathermore, allowances can be made for this fact in that, for example, the increase in the rate of flow is selected exponentially up to the desired value in order to accelerate the sluggish liquid volume initially. At all events such knowledge from prior fill operations for the relevant fill point can be reproduced precisely and stored in the rate value matrix together with the associated parameter values. Said parameter values in the case in example may be a desired change in the rate of flow at the fill point, which on account of the "learned" behaviour, is then no longer effected in an abrupt manner but rather increases exponentially in a subsequent fill operation, i.e. for the current rate of flow.

The object of the invention is also a device for filling in particular large volume containers with a liquid, said device preferably being suitable for carrying out the method depicted.

As a result, within the framework of the invention it is possible for the first time to optimize the fill operation with in particular carbonated beverages into large-volume containers, both as regards the rate of fill and also with respect to pressure fluctuations or pressure surges that are to be avoided. This can be attributed mainly to the fact that the method and the device access stored experienced data for similar liquid states (rate value of a prior fill operation) and constantly improve it by way of the current measurements in terms of a learning process (optimized current rate values). The essential advantages of the invention are to be seen here.

BRIEF DESCRIPTION OF THE DRAWINGS

The invention is explained below by way of a drawing representing just one exemplary embodiment, in which, in detail.

DETAILED DESCRIPTION

Figure 1:
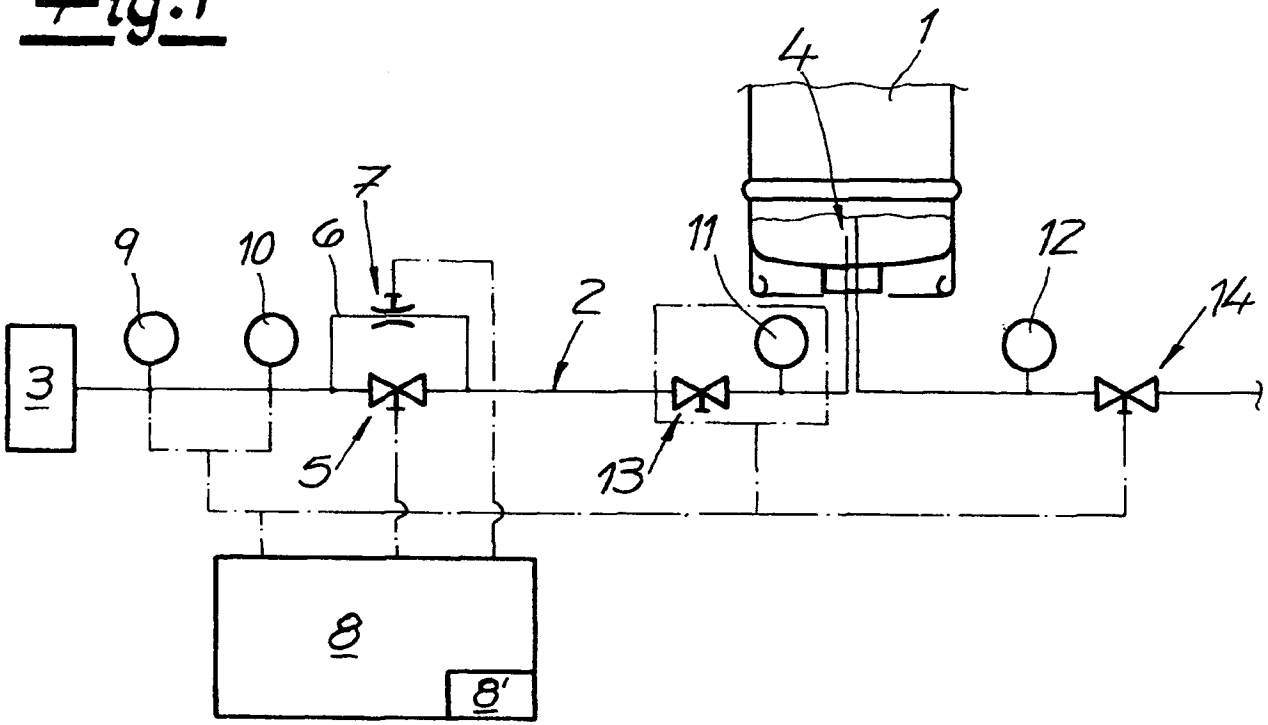
FIG. 1 shows a schematic representation of the device according to the invention and FIG. 2 shows a diagram of the fill operation, wherein on the y-axis the periodic change of the forwarded volume V, that is the rate of flow, is represented, whilst the x-axis identifies the fill level from 0% to 100%. In this case it must be noted that the integral of the curve (surface area) represents the filled volume.

FIG. 1 represents a device for filling in particular large-volume containers 1. The container 1 is a keg barrel 1, which, in this case, is filled with beer in the overhead arrangement, which does not have to be mandatory. The container 1 or the keg barrel 1 is filled by the flow or the rate of flow (periodic change in the forwarded volume V) of the beverage being controlled, in the exemplary embodiment, along a fill section 2 from a storage container 3 as far as the discharge opening 4. In principle, the pressure within the keg barrel could also undergo a change via a return air control system, however this is not represented.

An adjustable valve 5 is responsible for controlling the flow or adjusting the rate of flow of the liquid on its path from the storage container 3 to the discharge opening 4. Said adjustable valve 5, in the exemplary embodiment and in a non-restrictive manner, is combined with a bypass 6 with adjustable flow diaphragm 7. Both the adjustable flow diaphragm 7 and the adjustable valve 5 are each connected to a regulating unit 8, which, in the exemplary embodiment, is in the form of control unit 8 or is a component part of the same and monitors and controls the entire device.

In addition, a plurality of sensors 9, 10, 11, 12 can be seen along the fill section 2. The sensors 9, 11, 12 are each pressure sensors 9, 11, 12, whereas the sensor 10 is developed as flow sensor 10. In addition, a fill valve 13 and a gas valve 14 are also provided.

The pressure sensor 12 and the gas valve 14 are associated with a gas supply line, by means of which the keg barrel 1 is acted upon with the necessary propelling gas, as has already been described in the introduction. The pressure sensor 11 and the fill valve 13 are associated with the keg head and ensure that the keg barrel 1 is closed correctly after the fill operation. The two pressure sensors 11, 12 and the fill valve 13 and the gas valve 14 are not important to the present invention.

The fill operation takes place as follows. The liquid drawn off from the storage container 3 is measured by means of the pressure sensor 9 and the flow sensor 10 at the appropriate fill points or locations along the fill section 2. This produces parameter values for the pressure and the flow or the rate of flow, which are detected and used further by the control unit 8, as is explained in more detail below. One or more rate values of at least one prior fill operation are actually associated with the two parameter values, in the exemplary embodiment that is pressure and rate of flow. Said rate values are stored in a rate value matrix in the control unit 8 or in a memory 8' at that location. Such a rate value matrix, for example, can look similar to the following:

| | $Valve_1$ | $Valve_2$ | $Valve_3$ |
|---|---|---|---|
| $Pressure_1$ | Rate of $flow_{11}$ | Rate of $flow_{12}$ | Rate of $flow_{13}$ |
| $Pressure_2$ | Rate of $flow_{21}$ | Rate of $flow_{22}$ | Rate of $flow_{23}$ |
| $Pressure_3$ | Rate of $flow_{31}$ | Rate of $flow_{32}$ | Rate of $flow_{33}$ |

In the exemplary embodiment, there are consequently up to three different values of the pressure sensor 9 ($Pressure_1$, $Pressure_2$, $Pressure_3$) and three different positions of the valve 5 ($Valve_1$, $Valve_2$, $Valve_3$) all in all in each case nine rate values for the rate of flow of a prior fill operation (Rate of $flow_{11}$ to Rate of $flow_{33}$). By way of said rate value matrix, the position of the valve 5 can be predetermined in the exemplary embodiment by the control unit 8 depending on pressure measured by means of the pressure sensor 9 and the rate of flow determined by means of the flow sensor 10.

This means the current rate of flow of the liquid is predetermined as a function of the parameter values measured in parallel for the pressure and the flow in combination with the associated values from the rate value matrix, by the valve 5 taking up a position specified by the rate value matrix. In the exemplary embodiment, the $Pressure_2$ at the pressure sensor 9 and the Rate of $flow_{22}$ at the flow sensor 10 may be such that the valve 5 (initially) assumes the position $Valve_2$. The resultant current rate of flow (Rate of $flow_{22}$) can then be optimized with consideration to targets. In this case, it can be as short a time as possible for filling the keg barrel 1 up to a specific predetermined fill level.

For this purpose, the current rate of flow is raised, for example, and then compared with the rate of flow (Rate of $flow_{22}$) of a prior fill operation with consideration to the target of as short a fill time as possible. This can take place in terms of an iterative operation by means of a self-learning process. Once said operation has been completed, each optimized rate value (new Rate of $flow_{22}$) is stored in the control unit 8.

The current rate of flow is actually predetermined in terms of a closed control system. In this case, from the parameter values and the associated rate values of one or more prior fill operations as reference variables, the current rate value in each case is derived as actuating variable or rather the valve 5 undergoes a corresponding adjustment. The manner in which this occurs in detail is such that during the start phase of a filling of the keg barrel 1 but also in the end fill region, the rate of flow is effected completely or at least partially via the adjustable diaphragm 7 that is connected to the control unit 8. At the same time the valve 5 may be more or less open.

In this case, it is also possible, all in all, to operate a preliminary control system. Said preliminary control system takes into consideration that variations in the rate of flow brought about by a change in the position of the valve 5 do not become noticeable until after a certain delay because the fill points, that is the locations for the sensors 9, 10, are at a not inconsiderable distance from the container 1 to be filled. However the liquid situated in this region between the fill point (the pressure sensor 9) and the discharge opening 4 is influenced by any changes in the rate of flow and this is then taken into consideration in the course of the preliminary control.

The valve 5, for example, is actually not opened in an abrupt manner in this case, but, for example, along an exponential curve, as has already been described in the introduction. This means that any pressure surges or pressure fluctuations inside the fill section 2 are avoided. These adjusting characteristics for the valve 5 are produced on account of the fact that the control unit 8, on account of one or more prior fill operations, "knows" that the desired change in the rate of flow is only observed actually at the discharge opening 4 when the described, learned characteristics are used.

Figure 2:
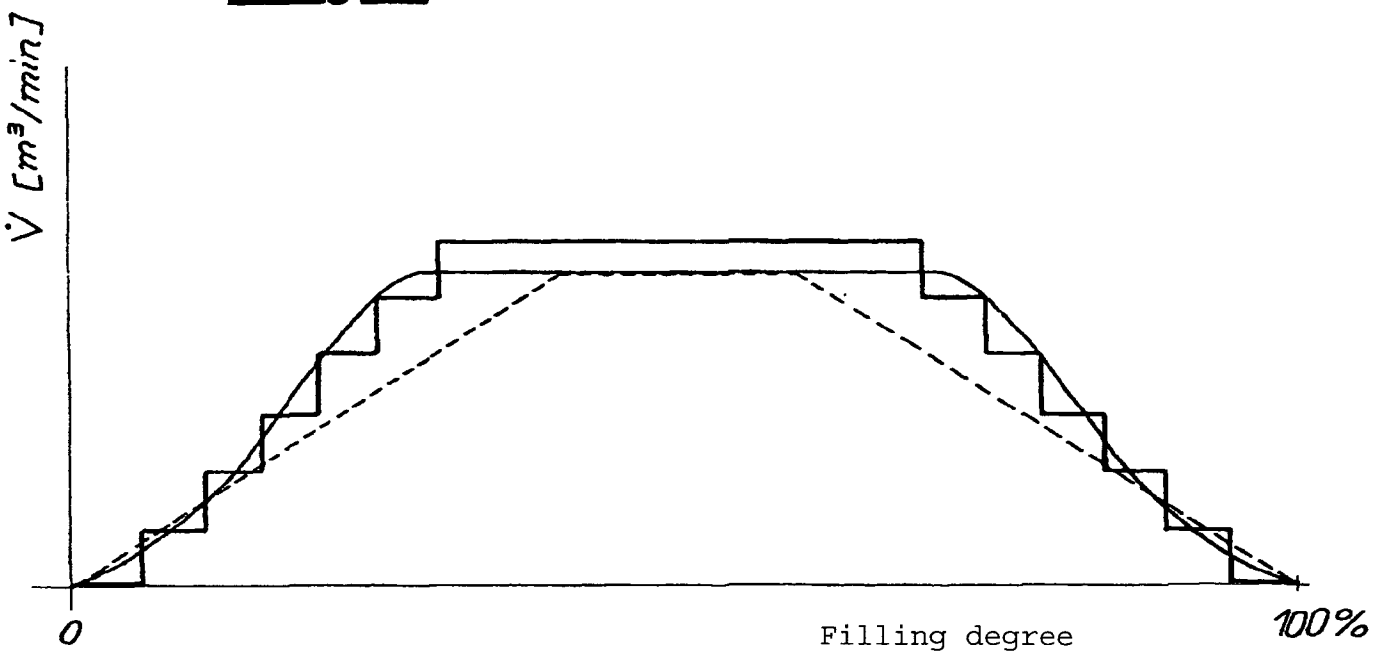

A course of the periodic change in the flow or the rate of flow V relative to the fill level is provided as a consequence of this method of operation, as is shown graphically in FIG. 2. In this case, the dot-dash curve mirrors the previous fill operation pursued in the prior art, whereas the two solid curves represent the fill operation corresponding to the invention. This applies both to a quasi smooth fill development and also to a rectangular fill development.

Translation of Words on the Figures

| FIG. 2 | |
|---|---|
| German | English |
| Füllgrad | Fill level |

The invention claimed is:

1. An apparatus comprising a device for filling containers with a liquid, said device comprising a sensor set, an adjustable valve, and a control system, wherein said sensor set is configured to measure a value of a parameter set, said parameter set having one or more parameter values, wherein said adjustable valve is configured to pre-set a flow rate of said liquid, and wherein said control system is configured to adjust said adjustable valve to achieve a particular current flow rate based at least in part on rate values for a prior fill operation associated with said parameter set.

2. The apparatus of claim 1, further comprising a bypass disposed to bypass said adjustable valve, and an adjustable flow diaphragm configured to adjust flow of said liquid through said bypass.

3. The apparatus of claim 1, further comprising a storage container for storing said liquid, a discharge opening for discharging liquid into a container, and a fill section between said storage container and said discharge opening, wherein said sensor set comprises sensors disposed along said fill section.

4. The apparatus of claim 3, wherein said sensors comprise a pressure sensor.

5. The apparatus of claim 3, wherein said sensors comprise a flow sensor.

6. The apparatus of claim 3, wherein said sensors comprise a temperature sensor.

7. The apparatus of claim 3, wherein said sensors comprise a $CO_2$ sensor.

8. The apparatus of claim 1, further comprising a source of a gaseous beverage, wherein said source is connected to said adjustable valve.

9. The apparatus of claim 1, wherein said control system is configured to optimize said flow rate to minimize fill time for a container connected to said adjustable valve.

10. The apparatus of claim 1, wherein said control system is configured to optimize said flow rate to minimize pressure surges at a container connected to said adjustable valve.

11. The apparatus of claim 1, wherein said control system is configured to optimize said flow rate to minimize pressure fluctuation at a container connected to said adjustable valve.

12. The apparatus of claim 1, further comprising a memory, wherein said memory is configured to have, stored therein, a rate matrix containing rate values for said prior fill operation associated with said parameter set.

13. The apparatus of claim 12, wherein said control system is a self-learning system that is configured for comparing said current flow rate with a flow rate of a prior fill operation associated with said values of said parameter set, and storing, in said rate matrix, only an optimized flow rate.

14. The apparatus of claim 12, wherein said control system is configured to determine a setting of an actuating variable for said adjustable valve based at least in part on information in said rate matrix.

15. The apparatus of claim 1, wherein said control system is configured to determine said value of said parameter set based at least in part on deviations in said current flow rate.

16. A method for filling containers with a liquid, said method comprising using a sensor, measuring a value of a parameter set, said parameter set having one or more parameter values, in a memory, storing a rate matrix containing rate values for a prior fill operation associated with said parameter set, providing an adjustable valve that is configured to pre-set a flow rate, and causing a control system to adjust said adjustable valve to achieve a particular current flow rate based at least in part on said rate values stored in said rate matrix.

17. The method of claim 16, further comprising optimizing said current flow rate to minimize fill time of a container.

18. The method of claim 16, further comprising comparing the current flow rate with a flow rate of a prior fill operation associated with the values of the parameter set.

19. The method of claim 15, further comprising measuring said value based on measurements made along a fill section between a storage container and a discharge opening.

20. The method of claim 15, further comprising determining a setting of an actuating variable for said adjustable valve based at least in part on information in said rate matrix.

* * * * *